US011141989B2

(12) United States Patent
Chen et al.

(10) Patent No.: US 11,141,989 B2
(45) Date of Patent: Oct. 12, 2021

(54) DUAL CHANNEL JETTING APPARATUS FOR 2D/3D ELECTROHYDRODYNAMIC (EHD) PRINTING

(71) Applicant: Virginia Commonwealth University, Richmond, VA (US)

(72) Inventors: Daren Chen, Glen Allen, VA (US); Hong Zhao, Glend Allen, VA (US)

(73) Assignee: VIRGINIA COMMONWEALTH UNIVERSITY, Richmond, VA (US)

( * ) Notice: Subject to any disclaimer, the term of this patent is extended or adjusted under 35 U.S.C. 154(b) by 138 days.

(21) Appl. No.: 16/476,676

(22) PCT Filed: Feb. 8, 2018

(86) PCT No.: PCT/US2018/017323
§ 371 (c)(1),
(2) Date: Jul. 9, 2019

(87) PCT Pub. No.: WO2018/148348
PCT Pub. Date: Aug. 16, 2018

(65) Prior Publication Data

US 2021/0138794 A1 May 13, 2021

Related U.S. Application Data

(60) Provisional application No. 62/456,782, filed on Feb. 9, 2017.

(51) Int. Cl.
*B41J 2/175* (2006.01)
*B41J 2/14* (2006.01)

(52) U.S. Cl.
CPC ..... *B41J 2/17596* (2013.01); *B41J 2/1433* (2013.01)

(58) Field of Classification Search
CPC ..... B41J 2/17596; B41J 2/1433
USPC ..... 347/54
See application file for complete search history.

(56) References Cited

U.S. PATENT DOCUMENTS

| | | | |
|---|---|---|---|
| 4,220,958 | A | 9/1980 | Crowley |
| 6,158,844 | A | 12/2000 | Murakami et al. |
| 2002/0038611 | A1 | 4/2002 | Naniwa et al. |
| 2002/0171724 | A1 | 11/2002 | Naniwa et al. |
| 2004/0001134 | A1 | 1/2004 | Nakazawa et al. |
| 2005/0185020 | A1 | 8/2005 | Fukunaga et al. |

(Continued)

*Primary Examiner* — Huan H Tran
*Assistant Examiner* — Alexander D Shenderov
(74) *Attorney, Agent, or Firm* — W&C IP

(57) ABSTRACT

An electrohydrodynamic (EHD) jet printing apparatus or system may include circulation of printing fluid to minimize or eliminate clogging in a nozzle. An exemplary nozzle comprises at least two ink channels—one allowing flow to a droplet emitting opening and one allowing flow away from the droplet emitting opening—configured for circulating ink. The nozzle may transfer ink to a substrate with an EHD technique involving voltage or current modulation. For example, an electric field may be applied between the nozzle and printing substrate such that the ink meniscus changes shape and releases ink from the tip of the liquid cone. A multi-channel nozzle may take a variety of configurations, including two co-axially aligned capillaries, side-by-side parallel capillaries, or capillaries arranged at an angle with respect to one another but converging at a single point where the conical meniscus is formed.

23 Claims, 8 Drawing Sheets

(56) References Cited

U.S. PATENT DOCUMENTS

| | | | | |
|---|---|---|---|---|
| 2006/0017782 | A1* | 1/2006 | Nishi | B41J 2/14209 347/55 |
| 2006/0077232 | A1 | 4/2006 | Nakazawa | |
| 2006/0261179 | A1 | 11/2006 | Davies et al. | |
| 2007/0013750 | A1 | 1/2007 | Furukawa | |
| 2008/0055378 | A1* | 3/2008 | Drury | B41J 2/20 347/92 |
| 2012/0007921 | A1 | 1/2012 | Govyadinov et al. | |
| 2012/0050357 | A1 | 3/2012 | Rasmussen | |
| 2012/0299999 | A1 | 11/2012 | Panchawagh et al. | |
| 2014/0158787 | A1 | 6/2014 | Chen et al. | |
| 2015/0062250 | A1 | 3/2015 | Byun et al. | |
| 2015/0266297 | A1 | 9/2015 | Lee et al. | |

* cited by examiner

DUAL CHANNEL JETTING APPARATUS FOR 2D/3D ELECTROHYDRODYNAMIC (EHD) PRINTING

CROSS-REFERENCE TO RELATED APPLICATIONS

This application or patent claims the benefit of U.S. Provisional Patent App. No. 62/456,782, filed Feb. 9, 2017, the entirety of which is herein incorporated by reference.

FIELD OF THE INVENTION

This disclosure involves electrohydrodynamic (EHD) jet printing and, more particularly, multi-channel nozzles and jetting apparatuses for EHD jet printing.

BACKGROUND

Printing as a fabrication method, especially inkjet printing, has advantages over other fabrication techniques to make 2D patterns on surfaces and even 3D structures. Advantages of inkjet printing include: i) direct writing: printing is a one-step additive process—depositing the material where it is needed, often resulting in less steps and less material waste comparing to photolithography fabrication; ii) using versatile inkjet materials: inks with metal nanoparticles, e.g. silver, gold, and copper, inks with graphene and conducting polymers, as well as semiconducting inks have been used in inkjet printing to fabricate functional devices in OLED, solar cells and field effect transistors (FETs); and iii) the ability to integrate into a low cost, high throughput, roll-to-roll manufacture process. Moreover, inkjet printing has been used by researchers to make cells, tissues and even organs. Inkjet printing technology has also been employed in layer-by-layer 3D printing, opening up broad applications in energy, medical, and pharmaceutical areas.

However, the current inkjet technologies, based on thermal (TIJ), piezo-actuated, electrostatic, and acoustic ink jetting, have constrained their application in micro-pattern fabrication because of fairly large droplet sizes produced (typically 10-50 μm in flight). In the literature, the smallest droplet size from conventional inkjet printing is about ~6 μm (0.1 pL). The droplet was achieved using a drop-on-demand silicon printing head fabricated completely by MEMS technology at an extremely high cost. The printing resolution of the conventional inkjet printing is mostly determined by the inner diameter (ID) of printing nozzles. Downscaling of the ID size typically results in the use of high actuating pressure to push droplets out which will eventually reach the intrinsic limitation of material and device in use. The nozzle size downscaling also presents a huge challenge in dealing with nozzle clogging: once a few individual nozzles are clogged the entire printing head module will need to be replaced.

Electrohydrodynamic (EHD) jetting is recognized as a relatively new high resolution printing technique. Prior to use in printing, EHD liquid ejection was perhaps best known for its application in electrospray and electrospinning. EHD jet printing shares many of the advantages of conventional inkjet techniques while having the capability of generating droplets in sub-micrometer sizes. Different from conventional inkjet printing, the liquid droplet in EHD jet printing is pulled out of the droplet emitting opening (rather than being pushed out). The droplet may be pulled out by an external electric field. When an electric field is applied between the printing head and substrate, the shape of a liquid meniscus at the droplet emitting opening of printing nozzles changes according to the balance among the surface tension, electrostatic force, and hydrostatic pressure.

In a typical nozzle-to-plate setup of EHD jet printing, various operational modes such as dripping, spindle, pulsating, cone-jet, and multi-jetting are available for use. All EHD jetting for micro/nano-patterning has employed the so-called "pulsating mode" in which one or multiple droplets are produced in a short burst. Generally, single capillary nozzles were applied in all previous works on EHD jet printing.

Under the pulsating mode, the liquid meniscus deforms into a cone shape when a high DC voltage is applied to the printing head. A liquid jet is emitted at the cone tip and liquid droplets are formed upon the jet breakup. The cone-shaped meniscus and jet are retracted to its original spherical shape after the electric field is removed. In all previous studies known to the inventors, a pulsed DC voltage is applied to the printing nozzle in order to realize drop-on-demand. With a pulsated DC electric field, the maximal jetting frequency is determined by the characteristic time of the meniscus expansion-ejection-retraction cycle, typically in a range of a few kHz. The neck-down ratio (i.e., the nozzle ID diameter vs. droplet diameter) in the spindle and pulsating ejection modes is typically 10 or less. Fine nozzles having one micron or even sub-micron ID have to be used to generate the features of a few hundred nanometers in the EHD jetting modes. Prior research has down-scaled the micro-dripping mode to the regime of nano-dripping by employing nozzles with the inner diameters (IDs) of 1.2 and 0.6 μm to make features with sizes up to 15 times smaller than the nozzle size.

Various materials have been demonstrated as usable with EHD printing, including inks with silver and gold nanoparticles, semiconducting nanoparticles, polymers and insulating materials, and magnetic materials. Such materials have been used to print 2D dot structures and 3D structures with a critical dimension of a few microns or less. Most of this research, however, focuses on the compatibility and printability of materials with EHD jet printing processes without in-depth investigation on the printing process and droplet-interactions. The state-of-the-art EHD jet printing, therefore, has several significant limitations not yet adequately addressed:

1. Nozzles with IDs of a few microns or sub-microns are easy to be clogged. Because of the limited size reduction in the dripping, spindle, and pulsating modes, nozzles with much small inner diameters and sharp tips are required to fabricate sub-micro-patterns. The smaller the IDs, the more prevalent the issue of clogging.
2. Existing techniques require long manufacturing times. A period of several minutes is often counted as a successful operation which is definitely not acceptable in a commercial manufacturing practice.
3. Difficulty in controlling extremely low ink flowrate required for printing often results in ink accumulation at the nozzle tip. The required ink flow rate for printing via single capillary nozzles is extremely small because of little ink consumption. The excessive ink is often accumulated at the droplet emitting opening of printing nozzles, significantly reducing jetting performance.
4. Drop-on-demand via pulsed voltages limits the jetting frequency to a few kHz. This is because of the time required to change the liquid meniscus from a round shape to a conical shape and to establish steady electrical current flow.

5. Size and uniformity of feature patterns may be problematic if bursts of droplets are ejected in one printing pulse. The production of multiple droplets in one voltage pulse could result in one large drop upon deposition on the substrate.

In view of the preceding problems in the art, there is a need for novel EHD jet printing apparatus, systems, platforms, and processes to enable the precise and reliable control of, for example, drop-on-demand jetting to fabricate superfine resolution micro/nano-patterns/features without concerns such as nozzle clogging and monodisperse droplets formation in high frequency (e.g., MHz frequencies).

EHD jet printing is a promising technique to achieve submicron features by production intent manufacturing. However, EHD jet printing has not been demonstrated as a reliable manufacturing platform because of the challenges described above, such as nozzle clogging, ink accumulation at the droplet emitting opening of printing nozzles, and low jetting frequency (low printing speed). Novel EHD jet printing apparatuses and techniques having a robust additive manufacturing capability are therefore in urgent need to realize the precise control of 2D patterning and 3D printing at the level of single micron or sub-micron resolutions.

SUMMARY

Some embodiments comprise printing processes and/or formation of micro/nano-patterns on substrates with current-modulated, electrohydrodynamic (EHD) jet printing with multi-channel (e.g., dual-channel) nozzles.

Control of pattern formation on printed substrates is achievable by regulation of jetting characteristics, droplet formation, and dynamics in EHD jet printing with novel multi-flow (e.g., dual-flow nozzles). Exemplary embodiments may possess the ability to reliably print a wide variety of materials with highly precise control, e.g., in single micron (1 μm) or submicron (<1 μm) resolution. Larger resolutions may also be printed by such nozzles when desired. Exemplary embodiments are compatible with a wide range of existing functional inks and with a wide range of ink rheology.

The topography and structures of printed patterns and structures may be determined based on one or more parameters of the jetting apparatus. Parameters which may be controlled in exemplary EHD printing processes comprise one or more (e.g., all) of: dynamics of liquid meniscus, jetting and drop formation, and their relationships with printing process parameters and ink properties.

Exemplary jetting apparatus may be, for example, a nozzle, a part of a nozzle, a printhead, an EHD printing system comprising multiple nozzles, the combination of one or more nozzles and a stage, the combination of one or more printheads and a stage, among others.

Advantages of exemplary printing nozzles and/or current-modulated EHD jet printing may include the fabrication of high-precision 2D patterns and 3D features in high speed. Further advantages may include minimization or elimination of nozzle clogging and reduction or elimination of existing difficulties in ink flowrate control (which tend to result in ink accumulation at droplet emitting openings of nozzles). Ink flow rates in respective channels may be independently controlled to provide greater control over droplet size and to reduce, minimize, or eliminate excess accumulation of ink at a nozzle's droplet emitting opening.

According to another exemplary aspect of some embodiments, ink materials such as conductive inks, semi-conductive inks, dielectric materials, polymers, nano metallic inks, conductive polymer inks, and 2D semiconductor and insulator materials can be reliably patterned using disclosed EHD jet printing apparatuses and processes for production of, for example, high-performance electronic applications. The printed components and sub-devices may include but are not limited to transistors, antennas, circuits, interconnects, sensors, batteries, and more. Such components may be integrated into a wide range of electronics such as but not limited to wearable electronics, mobile devices, flexible displays, photovoltaics, batteries, smart labels, packaging, and medical and environmental devices. The ink materials may also be UV curable polymers for 3D printing.

Some embodiments may comprise a hybrid inkjet-EHD printing system for the production of, e.g., a 3D object with fine features. Exemplary EHD jet printing may also be applied to print biological materials for complex bio-sensors and bio-tissues.

Further advantages of some embodiment may include the production of high resolution, high performance devices with scalable processes that have high throughput and high volume; high-resolution, low-cost manufacturing; and improved smart devices with embedded high-performance printed electronics, incorporating personalization and functionality.

Droplet ejection may be achieved by either current modulation or voltage modulation. Current modulation may provide particular advantages such as high jetting frequency (i.e., high speed printing).

Exemplary EHD jet printing apparatuses and processes may enable low-cost, reliable, drop-on-demand, and/or high speed manufacturing platforms with a micron/submicron/nano printing resolution. By the configurations of the jetting mechanisms and controlling the droplet deposition, embodiments may also provide novel drop-on-demand additive printing to yield precise control of superfine resolution in 2D patterning and 3D printing.

In one aspect, an exemplary embodiment is a jetting apparatus for electrohydrodynamic (EHD) printing, comprising at least one droplet emitting opening for ejecting a printing liquid; at least two channels configured to permit contemporaneous delivery of the printing liquid to the droplet emitting opening and withdrawal of printing liquid from the droplet emitting opening; and one or more electrodes configured for application of a voltage or current so that printing liquid at the droplet emitting opening forms a conical meniscus. The jetting apparatus may further comprise a flow controller configured to control printing fluid flow in the at least two channels and to continuously circulate or recirculate printing fluid past the droplet emitting opening using the at least two channels during ejection of droplets and during time between ejection of droplets.

In another aspect, the at least two channels of a jetting apparatus may be configured such that the circulation or recirculation past the droplet emitting opening prevents any printing fluid stagnation at the droplet emitting opening. The flow controller may be configured such that rates of printing fluid flow delivery and printing fluid flow withdrawal are independently adjustable to be the same or different. The flow controller may comprise one or more pumps or pressure regulators. The one or more pumps or pressure regulators may consist of a single pump or pressure regulator configured to recirculate printing fluid. The one or more pumps or pressure regulators may comprise at least two pumps or pressure regulators, one configured for printing fluid delivery and the other configured for printing fluid withdrawal.

In another aspect, the jetting apparatus may be configured to print a plurality of independent droplets with a continuously maintained conical meniscus. The jetting apparatus may comprise a jetting controller configured to modulate one or more of voltage and current signals transmitted to the one or more electrodes and thereby control droplet ejection. The jetting controller may comprise a current modulation circuit and is configured to control droplet ejection with current-modulation. The jetting controller may be configured to control droplet ejection with voltage-modulation. The jetting apparatus may be configured for drop-on-demand printing. The jetting apparatus may be configured to print a plurality of independent droplets with a continuously maintained conical meniscus.

In another aspect, the at least two channels of a jetting apparatus may be tubules or capillaries. The jetting apparatus may be configured to eject droplets with at least some droplets which are 1 micron or less resolution. The droplet emitting opening of a jetting apparatus may have a diameter of 100 μm or less. The at least two channels of the jetting apparatus may be coaxial with one another. The at least two channels may comprise three or more channels.

In another aspect, a jetting apparatus may be a nozzle. In another aspect, a jetting apparatus may be a printhead with a plurality of nozzles. In another aspect, an EHD printing system may include the jetting apparatus as well as a substrate for receiving ejected droplets, the substrate being held on a stage; one or electrodes on one or more of the nozzle, substrate, and stage, wherein the one or more electrodes are configured for application of a voltage or current modulation for ejecting the printing fluid from the at least one droplet emitting opening; and a power source for applying an electrical field to the one or more electrodes. The jetting apparatus may include the stage.

In another aspect, a jetting apparatus may be configured to print a component selected from a group consisting of: transistors, antennas, circuits, interconnects, sensors, and batteries. In another aspect, the jetting apparatus may be configured to print a component of a wearable electronic, mobile device, photovoltaic, or medical device.

DETAILED DESCRIPTION

The term "ink" is used for convenience in this disclosure, but exemplary devices and systems may use any suitable printing fluid, e.g., liquid or liquids. Exemplary embodiments may use any of one or more of different printing fluids, including but not limited to colloidal suspensions; inks with metal nanoparticles, e.g. silver, gold, and copper; inks with graphene; conductive inks; polymers; conductive polymer inks; semiconductive inks; dielectric materials; nano metallic inks; 2D semiconductor materials; insulator materials; and other materials.

Figure 1A:
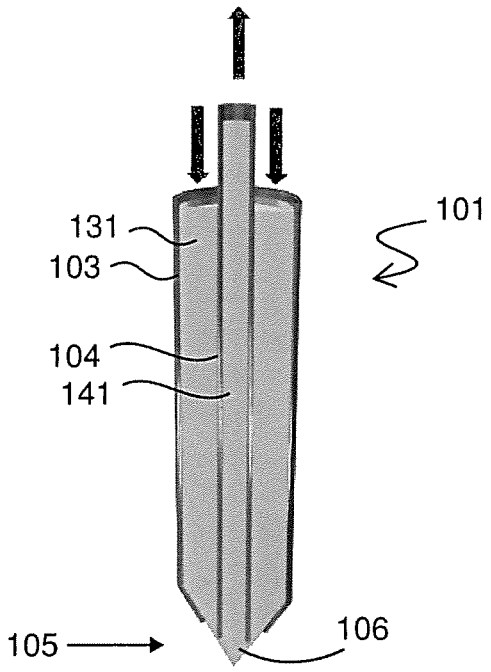
FIG. 1A is a first example of a multi-channel electrohydrodynamic jet printing nozzle with a circulating ink path.

FIG. 1A shows a jetting apparatus, and in particular an exemplary dual-channel electrohydrodynamic nozzle 101 with a circulating ink path. FIG. 1A is a cross-sectional view taken along a longitudinal plane of symmetry. Note that a "nozzle" may comprise additional components or extensions beyond what is explicitly shown in the illustrative figures herein. The nozzle 101 comprises multiple ink flow channels, including a first channel 103 and a second channel 104. The channels 103 and 104 are coaxial and concentric, with the second channel 104 being annular and encompassing the first channel 103. Both channels open at a distal end 105 of the nozzle 101. The opening at the distal end 105 is a droplet emitting opening 106. The droplet emitting opening 106 is in fluid communication with both the first channel 103 and the second channel 104. As may be appreciated from FIG. 1A, individual channels 103 and 104 may be accurately described as having their own respective ends or openings. However, these individual channel ends may collectively constitute a single droplet emitting opening. Most often a single droplet emitting opening in a state of use corresponds with a single ink meniscus. Droplet emitting openings may take a variety of sizes, but generally the sizes are small as compared to convention inkjet printing. The size of an inner diameter (ID) of a nozzle and/or the diameter of a droplet emitting opening may be, for example, 20 μm or less, 15 μm or less, 10 μm or less, 6 μm or less, 5 μm or less, or 1-5 μm. Of course, in some embodiments, an ID or diameter of a droplet emitting openings may be greater than 20 μm.

In FIG. 1A, exemplary ink flow is illustrated schematically with arrows. For the nozzle operation, printing ink is continuously injected into one of two channels and extracted from the other of the two channels. The arrows in FIG. 1 illustrate ink injection via channel 103 and ink extraction via channel 104. The net direction of ink flow in channel 103 is toward opening 106, while the net direction of ink flow in channel 104 is away from opening 106. As a general matter, "delivery", "injection", "feeding", and "supplying" may be used interchangeably in this disclosure. As a general matter, "withdrawal" may be used interchangeably with "extraction" or "suction", for example. For consistency, however, the terms "delivery" and "withdrawal" may be used most prevalently when distinguishing between these two complimentary channel functions. In some cases other terms or expression may be substituted.

Figure 1B:
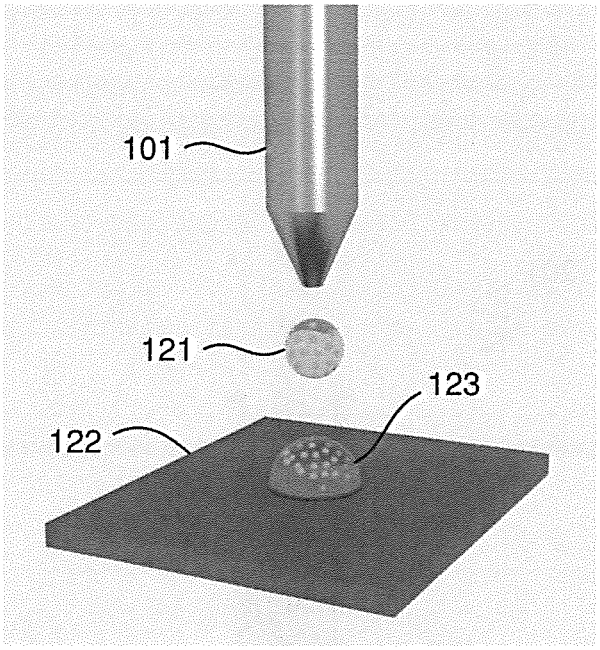
FIG. 1B is an illustration of exemplary EHD printing in progress.

In an exemplary state of use, droplets of ink are emitted (i.e., ejected) at the droplet emitting opening 106, as generally illustrated in FIG. 1B. Note that in FIG. 1B, emitted droplet 121 is not shown to scale with the nozzle 101; the droplet 121 is enlarged to permit the droplet to be clearly viewed in the drawing. For an accurate portrayal of the relative size between an example droplet and the conical meniscus at the end of a nozzle, see FIG. 3B, discussed below. Emitted droplets may be deposited on a substrate 122. Multiple droplets (e.g., 121, 123, etc.) may be deposited at the same point/location on the substrate 122. This may be performed during an additive manufacturing process, for example.

Figure 1C:
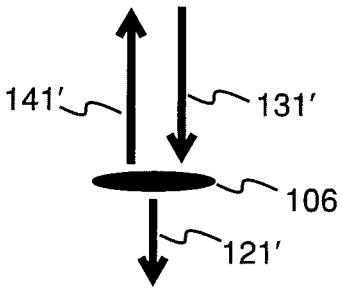
FIG. 1C is a diagram of sources and drains to a nozzle tip.

FIG. 1C is a schematic which summarizes ink flow of both sources and drains with respect to a nozzle tip, and in particular a droplet emitting opening 106. There are at least three independently identifiable ink flows which collectively define the net flow at droplet emitting opening 106. In reality other factors may influence ink volume at opening 106, e.g., solvent evaporation. These factors may be assumed negligible as compared to the sources/drains illustrated in FIG. 1C.

Flow 131' is (a measure of) flow associated with ink 131 in channel 103. More generally, flow 131' is ink flow associated with one or more channels configured for ink delivery to a nozzle tip. Flow 141' is (a measure of) flow associated with ink 141 in channel 104. More generally, flow 141' is ink flow associated with one or more channels configured for ink withdrawal from a nozzle tip. Flow 121' is a measure of flow associated with ink consumed by being printed to a print substrate or medium, e.g., substrate 122 in FIG. 1B. Since jetting of droplets may be intermittent, this flow may be expressed as an average flow over a period of time during which there is both jetting and no jetting. At smaller resolutions of time, flow 121' may show rapid changes. Because droplets may be emitted intermittently, flow 121' may be zero at times during which no jetting of droplets is occurring. Conversely, flow 121' is non-zero at times where droplets are ejected. In some embodiments, the magnitude of flow 121' may be significantly less than the magnitude(s) of flow 131' and/or flow 141' even when magnitude of flow 121' is non-zero.

It is advantageous to carefully control the volume of ink at opening 106. Precise control of the volume of ink at opening 106 is advantageous because it improves the precision of emitted droplet size, for example. To control ink volume at opening 106, flows 121', 131', and 141' may be independently controlled. In other words, the magnitude of each of the three flows may be changed without necessarily requiring a change in the other two flows. This being said, it may be the case a particular device or system is configured to change one ink flow (121', 131', or 141') based on changes in one or two of the other flows (121', 131', or 141'). In other words, though an embodiment may include the capability for flow in one or more channels to be changed independently, dependency relationships may be established. For example, it may be advantageous for some printing operations for the net flow of ink at opening 106 to be zero. In this case, ($flow_{131'}$+$flow_{121'}$) must equal ($flow_{141'}$). When an embodiment changes mode from an inactive state (e.g., no jetting is occurring) to an active state (e.g., jetting is actively occurring) flow 121' changes from zero to a non-zero value. Printing ink is being actively consumed by the printing process. To compensate for the change in flow 121', the embodiment may be configured in one of several ways. First, flow 131' may be increased and flow 141' may be unchanged. Second, flow 131' may be unchanged and flow 141' decreased. Third, both flows 131' and 141' may be changed so long as it remains true that ($flow_{131}$+$flow_{121}$) equals ($flow_{141}$). Thus, for example, the volume of ink passing through channel 103 and delivered at the opening 106 may be greater than the volume of ink withdrawn from opening 106 and passing through channel 104. An exemplary device or system may be configured such that the greater the volume of ink consumed by jetting, the less volume of ink withdrawn via channel(s). In other words, the greater the flow 121', the lesser the flow 141'.

In exemplary embodiments, ink flow past the droplet emitting opening is continuous during a printing operation (e.g., when the nozzle is on/not stored). This may be true even when the net flow is zero. Thus, flow 131' may never be zero, and flow 141' may never be zero, except when the nozzle may be stored away. Non-zero flows may be very small and yet effective to prevent clogging. For example, a non-zero flow for 131' or 141' may be, for example, 20 μl/min or less, 15 μl/min or less, 10 μl/min or less, 5 μl/min or less. Other flow rates may be employed. When nozzled are stored, flow rates may be zero. Nozzles may be stored after being flushed with a cleaning solution or else by tip immersion in a solvent or ink bath which keeps the nozzle tips wetted for extended periods of disuse (e.g., overnight at a manufacturing facility which does not continue operations around the clock).

The respective channels and flow rates may be configured such that the circulation or recirculation past the droplet emitting opening prevents any ink stagnation at the droplet emitting opening. Accumulated ink at opening 106 is ink which remains at or near the opening 106 for an undesired amount of time without being either emitted as a droplet or else withdrawn from opening 106 through channel 104. Circulation of printing ink is achieved by creating a flow of ink past the droplet emitting opening 106. Unconsumed printing ink can be continuously recirculated, in which case some of the same molecules of ink may be delivered and withdrawn multiple times as they flow through a looped circuit.

Nozzle 101 and other exemplary jetting apparatuses consistent with this disclosure are configured to overcome issues often encountered in EHD jet printing operations which employ single capillary nozzles. Those issues include, for example, nozzle clogging and ink accumulation at the droplet emitting opening. In exemplary embodiments herein, multi-channel nozzles combined with ink circulation/recirculation overcome such problems which plague single channel nozzles. A proof of concept embodiment demonstrated that EHD jetting with a nozzle 101 is operable for hours without the aforementioned issues (i.e., clogging and accumulation).

FIGS. 2A to 2F show several further example nozzles and flow path configurations which are alternatives to that which was introduced in FIG. 1A. Embodiments of the invention may involve one or more of these example nozzles and/or variants thereof. Some embodiments may incorporate separate features from among the different examples of this disclosure.

Figure 2A:
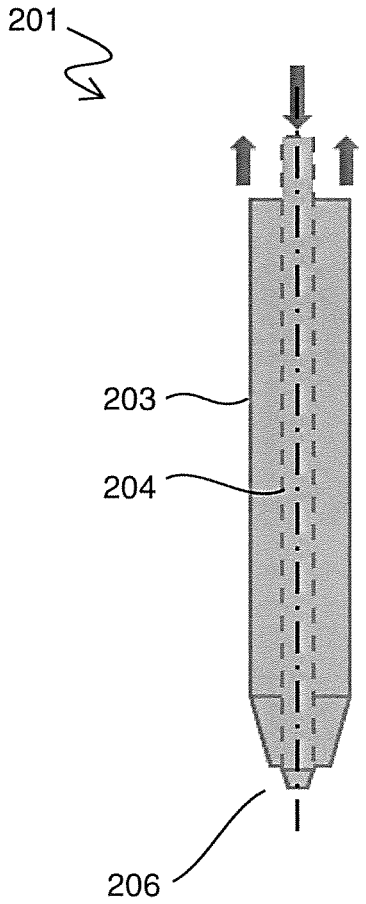
FIG. 2A is a second example of a multi-channel printing nozzle.

In FIG. 2A, nozzle 201 comprises two ink channels, 203 and 204, which are co-axial and result in a co-axial flow channel configuration. Here the channels' physical configuration is similar to that of the nozzle 101 in FIG. 1A, at least with respect to geometric considerations. However, as between nozzles 101 and 201, the roles of the channels (delivery and withdrawal) are reversed. For nozzle 201, the inner channel 204 is configured to deliver ink to the droplet emitting opening 206 and the outer channel 203 is configured to withdraw ink away from the droplet emitting opening 206.

In a coaxial flow configuration, flow channels (e.g., inner and outer channels) in the printing nozzle may be constructed by co-axially aligning two capillaries. Printing fluid (e.g., ink) may be fed into the inner flow channel and extracted from the outer one, or vice versa. According to an exemplary printing process employing such nozzles, ink may be continuously recirculated between the two channels to minimize ink waste. By the above operation, the ink near the droplet emitting opening is continuously flowing and thereby prevents the opening from clogging, even as jetting is occurring (i.e., as droplets are being generated and deposited on a substrate). The primary liquid/ink flow may be kept continuously moving from the inner channel to the outer channel, and the issue of liquid accumulation at the droplet emitting opening may be minimized by tuning the flowrates in respective channels. As illustrated by a comparison between nozzles 101 and 201 of FIGS. 1A and 2A, respectively, the flow delivery and withdrawal described above may be reversed for nozzle operation. In some embodiments, the very same nozzle may be configured to reverse direction based on the setting of a flow controller.

Figure 2B:
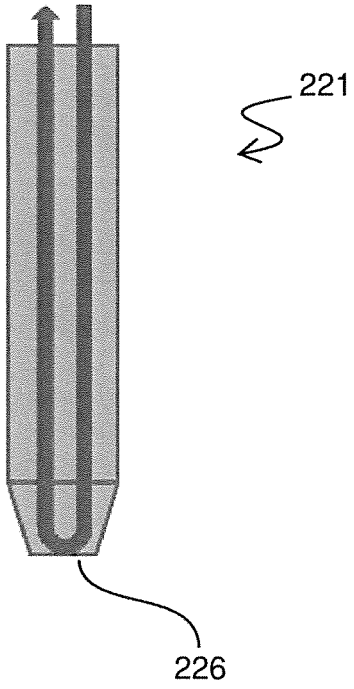
FIG. 2B is a third example of a multi-channel printing nozzle.

FIG. 2B is a nozzle 221 with a bypass flow configuration. In a bypass flow design, the proposed nozzle may have two adjacent fluid flow channels connected to the same droplet emitting opening. As with the coaxial configurations, the ink liquid is fed in one channel and extracted via the other. Two, three, or more channels may be configured together in this way.

Though the preceding illustrative examples illustrate nozzles with two channels, one channel configured for ink flow to the droplet emitting opening and the other channel configured for ink flow away from the droplet emitting opening, multi-channel embodiments may be provided which comprise three or more channels. For instance, embodiments may have three, four, five, six, seven, eight, nine, ten, or more than ten channels. For example, FIGS. 2C, 2D, and 2E, show an embodiment with four ink channels.

Figure 2C:
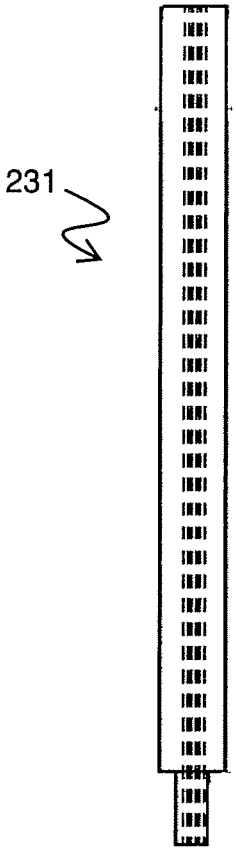
FIGS. 2C to 2E collectively show a fourth example of a multi-channel printing nozzle.
Figure 2D:
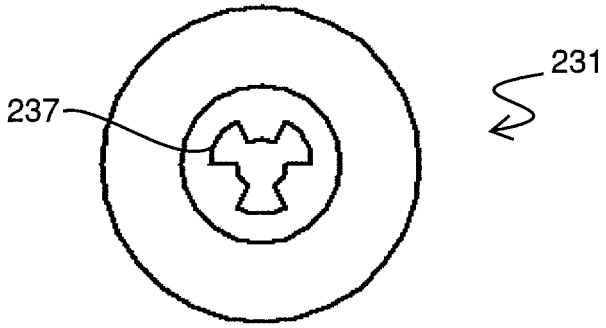
Figure 2E:
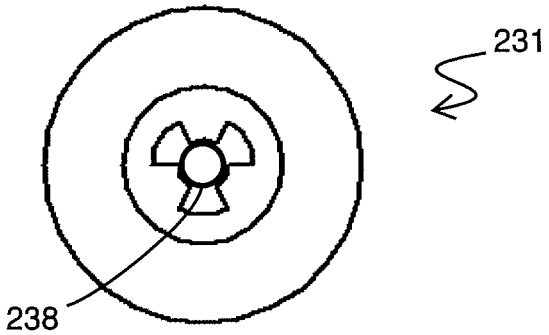

FIGS. 2C, 2D, and 2E show a nozzle 231 comprising four ink channels. FIG. 2C is a side view; FIG. 2D is a bottommost end view at an intermediate stage of manufacture; and FIG. 2E is a bottommost end view at a completed stage of manufacture. In general, exemplary nozzles herein may be manufactured from suitable metals (e.g., aluminum, steel, stainless steel, brass, etc.) or some combination thereof. Nozzles may also or alternatively comprise other nonmetal materials, such as silicone, glass, polymers, plastics, and/or surface treatments. An exemplary nozzle 231 of aluminum, for example, may be manufactured through a process involving electrical discharge machining (EDM).

A rod as in FIG. 2C (but with a solid core) may first be produced according to known machining methods. A multi-lobed (e.g., three-lobed) channel 237 as depicted in FIG. 2D may then be cut by EDM. The resulting three-lobed channel 237 includes volume/space both for delivery channel(s) and for withdrawal channel(s). An inner capillary 238 may then be inserted within the lobed channel 237. The inner capillary 238 and lobed-channel 237 are configured (e.g., sized, shaped, and arranged) with respect to one another so that the inner capillary 238 partitions the lobed-channel 237 into separate channels. The inner capillary 238 may also be centered by the separation walls of the three lobes, as apparent in FIG. 2E. The respective lobes of what was channel 237 now form three separate flow channels.

Configured within a printing system, the three outer channels may be configured as withdrawal channels, and the inner channel/capillary may be configured as a flow delivery channel. As with prior exemplary embodiments discussed above, in alternative configurations, one or more of the channels' functional roles (delivery or withdrawal) may be switched. The nozzle 231 is three-lobed/four channeled. Other embodiments may be similarly constructed but instead have four, five, or more lobes for creating five, six, or more channels, respectively.

Figure 2F:
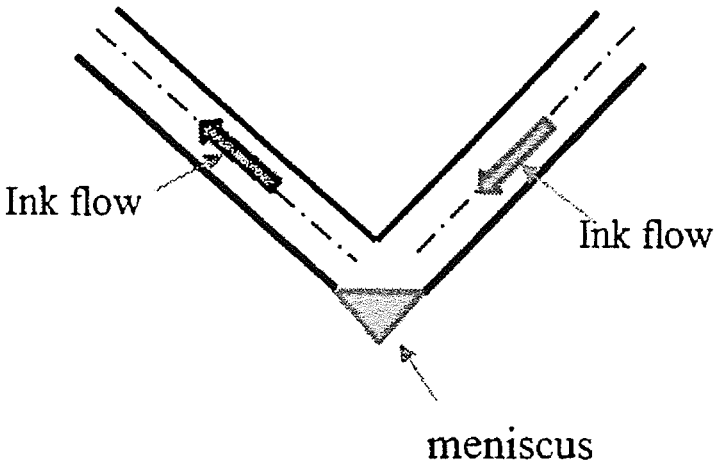
FIG. 2F is a fifth example of a multi-channel printing nozzle.

FIG. 2F is yet another example nozzle configuration, this time illustrating a channel arrangement in which the longitudinal axes of the channels are neither parallel to one another nor normal to a printing surface (assumed to be horizontal, as is ordinarily the case). In FIG. 2F, each channel's longitudinal axis forms a substantially 45 degree angle with respect to horizontal and approximately 90 degrees with respect to one another. Other angles between 0 and 90 degrees may also be employed for different embodiments.

Figure 3A:
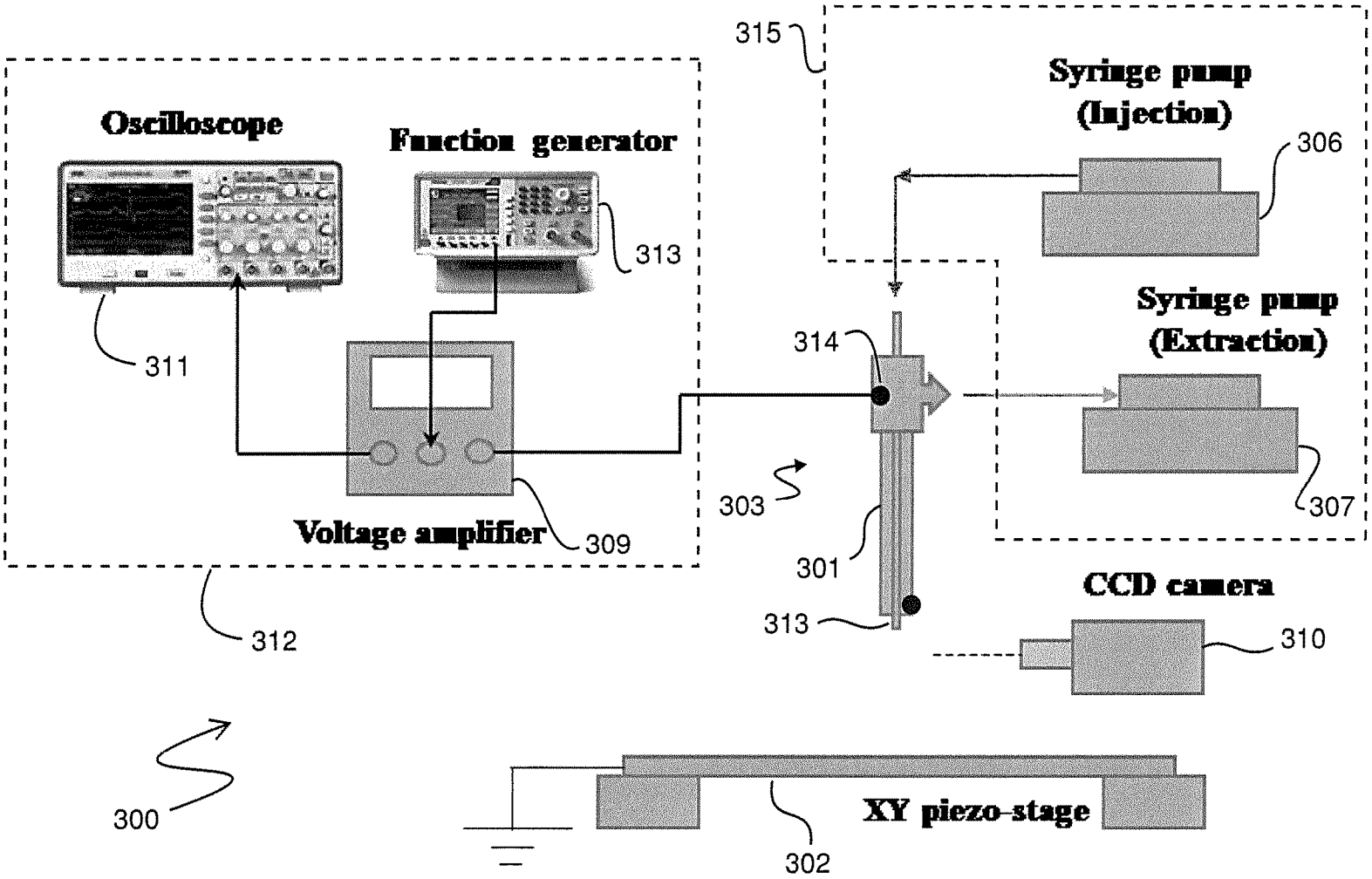
FIG. 3A is a schematic diagram of an exemplary EHD printing system.

FIG. 3A shows an example EHD jet printing system 300 comprising printing, feedback/monitoring, and control elements. The printing system comprises a jetting apparatus 303 which comprises one or more nozzles 301. A nozzle 301 comprises at least two channels (e.g., two channels, three or more channels, etc.) which may be configured so as to permit circulation or recirculation of ink to produce a continuous ink flow at a droplet emitting opening of the nozzle. A plurality of nozzles may be combined in a jetting apparatus that is configured as a printhead. The system 300 further includes a stage 302 which is configured as a second electrical terminal or ground. Control of an electric field generated between the stage 302 and nozzle 301 (via one or more electrodes 314) may be used to control droplet ejection in EHD jet printing. The stage 302 and/or nozzle(s) 301 may be configured for changing position (e.g., in a two-dimensional plane like the X-Y plane or in three-dimensional space including translation in X, Y, or Z and/or rotation according to one or more spatial coordinate systems).

The electrodes 314, by which a voltage or current modulation signal is applied, may be arranged on either a nozzle or on the stage which opposes the nozzle. In FIG. 3A, the electrodes 314 are on the nozzle and the stage is grounded. In some embodiments this arrangement may be reversed such that the stage is subjected to the voltage or current modulation and the nozzle is grounded. In still other embodiments, the nozzle and the stage may both receive electrical modulation signals. In any case, EHD printing generally requires an electrical field between the nozzles and stage. A variety of electrical configurations may be employed to achieve the required electrical field.

The system 300 further comprises a flow controller 315 which may comprise, for example, an injection pump 306 and an extraction pump 307. The flow controller 315 (and the pump(s) thereof) is configured to circulate or recirculate ink past the droplet emitting opening 313 using the channels of the nozzle 301. In general a flow controller may comprise one or more pumps or pressure regulators for continuously circulating or recirculating ink during the printing operation. As used herein, "continuous" may be used to describe circulation or recirculation which is substantially ongoing during use of a nozzle (e.g., when a nozzle is not in a stored configuration). For instance, if a jetting apparatus (nozzle or printhead) is used in a printing operation for seven hours, ink flow generated by the flow controller would be ongoing for at least seven hours, concurrent with the printing operation. Circulation or recirculation may continue without pause even during conical meniscus formation and ejection of droplets.

The system 300 further comprises a jetting controller 312. The jetting controller may comprise or consist of, for example, an electrical control circuit configured to control, regulate, and change the electrical properties of the jetting apparatus 301 in relation to the stage 302. As illustrated in FIG. 3A, jetting controller 312 may comprise a voltage source/amplifier 309, a function generator 313, and monitoring equipment like oscilloscope 311 to monitor the electrical parameters employed. The jetting controller 312 may comprise hardware, software, and/or firmware configured for controlling the electrical activity and thus printing/jetting activity of the jetting apparatus 303. The jetting controller 312 may comprise one or more computers or processors.

The system 300 may further comprise a feedback module which may comprise a vision system, for example a CCD camera 310, to monitor the printing operation. Further or alternative monitoring apparatuses and subsystems may be provided, e.g. at an industrial level, to ensure conformity of the power supply to and printing operation within predetermined parameters and tolerances. The schematic of system 300 uses camera 310 and oscilloscope 311 as exemplary but non-limiting monitoring apparatuses.

The voltage source/amplifier 309 may be connected to or comprise a function generator 313 for controlling the voltage modulation. An alternative configuration for system 300 is to substitute or reconfigure the voltage source 309 as a current source. The function generator 313 may then be configured for controlling the current modulation. The voltage source 309 or current source, as the case may be, may be connected to one or more electrodes 314 configured for applying a variable voltage or current so that ink at the droplet emitting opening forms a conical, in particular a cone-jet, meniscus and discharges droplets according to a desired print pattern or structure. In some embodiments, e.g. some embodiments which use voltage regulation, the electrical aspects of EHD printing may be substantially as described in conventional EHD printing setups and methods (e.g., see voltage regulation disclosed in U.S. Pat. No. 9,487,002).

For simplicity of the schematic representation, FIG. 3A shows only one nozzle 301 which is representative of one or a plurality of nozzles. In an industrial system and process, a large plurality of nozzles may be configured together in a printhead and operated simultaneously for high throughput operations. Experimental validation of the setup of system 300 has resulted in successful printing for several hours or longer without clogging. Single capillary nozzles fail to perform anywhere near as well as the multi-channel nozzles disclosed herein which are configured for continuous ink flow during the printing operation.

In some embodiments the flow controller may have a single pump configured to circulate or recirculate ink. In other embodiments the flow controller may comprise at least two pumps, one configured for ink injection and the other configured for ink extraction (see, e.g., flow controller 315 of FIG. 3A).

Exemplary embodiments may provide independent control of a flow controller 315 and a jetting controller 312. In effect, ink flowrate and jetting (i.e., the actual printing) are controlled independently in the EHD jet printing process. Since both jetting and ink extraction reduce the amount of ink at the droplet emitting opening of a nozzle, independent control of these two variables (jetting and ink injection/extraction) permits a heightened degree of control over the precise amount of ink at the droplet emitting opening as a function over time.

Figure 3B:
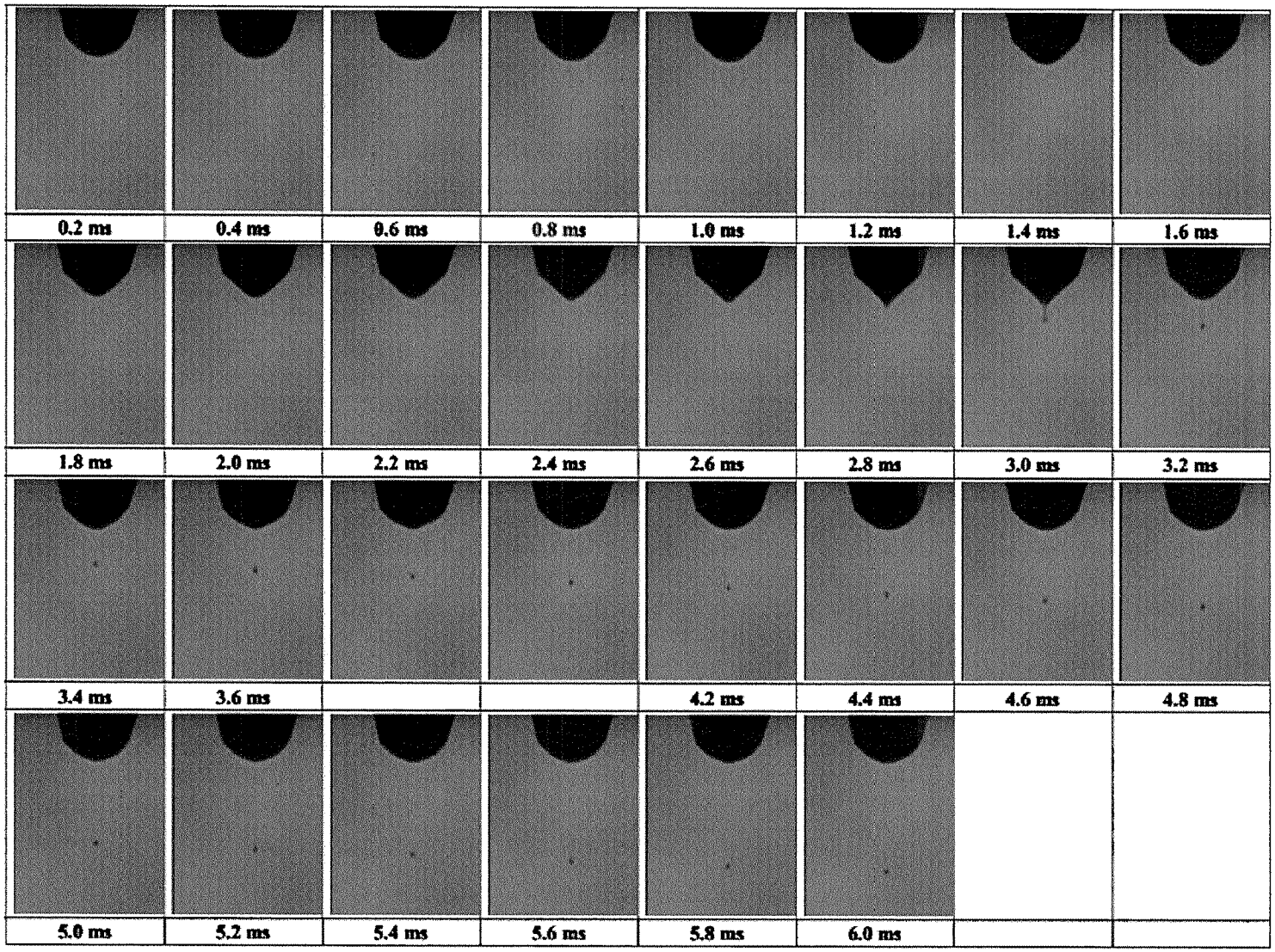
FIG. 3B is a series of photographs of EHD printing using an exemplary prototypical EHD jet printing apparatus comprising a dual-channel nozzle in coaxial configuration and operated with programmed voltage modulation.

FIG. 3B shows actual photographs from a high speed camera monitoring a printing operation conducted with a system according to FIG. 3A. FIG. 3B shows via time-sequence shots changes in the liquid meniscus at the droplet emitting opening of a nozzle when a pulsed voltage superimposed with a DC offset voltage was applied in each EHD jet printing cycle using a dual-channel nozzle consistent with FIG. 1A. A mixture of 50 v %/50 v % of Isopropanol (IPA) and Oleic Acid (OA) was used as the printing fluid and the printing was operated at 167 Hz in the test which produced the images of FIG. 3B.

As visually apparent from FIG. 3B, an emitted droplet that is jetted from a nozzle may be orders of magnitude smaller (e.g., in volume as well as in geometric size) than the conical ink meniscus from which it separates. This is particularly apparent in the 3.0 ms and 3.2 ms photographs of FIG. 3B. This size disparity is a contributing factor to the high prevalence of nozzle clogging in conventional EHD jetting systems. A comparatively large volume of ink is required to be retained in the nozzle tip in order to print, yet the amount of ink consumed by the printed droplets is comparatively small. Ink which remains at a jetting tip for too long is subject to drying out and clogging the channel(s) which lead to the tip. Exemplary embodiments address this problem via the circulation or recirculation of ink past the droplet emitting opening (i.e., droplet ejection opening).

The precise extent of ink movement brought about by circulation or recirculation may vary among embodiments. For example, in some embodiments, the furthest extent of ink movement induced by the circulation or recirculation described herein may include surface molecules at the ink-air interface of the dome or conical meniscuses (such interfaces are shown in FIG. 3B). In some embodiments, the furthest extent of ink movement induced by re/circulation may include sub-surface molecules of an ink meniscus but exclude surface molecules of the ink meniscus. In EHD printing, electrical charge accumulates on the surface of the ink meniscus. The system may be configured so that surface molecules affected by the electrical field are not affected by the re/circulation. In some embodiments, the furthest extent of ink movement induced by re/circulation may be at the top edge of the ink meniscus. This may correspond with the bottommost edge of the nozzle (e.g., bottommost edge of glass or metal, from which the ink meniscus generally projects down further, as shown by the FIG. 3B photographs). In some embodiments, the furthest extent of ink movement induced by re/circulation may be at a location above the bottommost edge of the nozzle. Generally speaking, an exemplary embodiment may be configured such that the following is true: of the total volume of ink in a nozzle at a given time, the percentage of ink with movement induced by re/circulation is maximized.

Embodiments such as nozzle 101 of FIG. 1A may be configured such that a cross-over point from a delivery channel to a withdrawal channel is as close as possible to the distal end of the nozzle. In the case of nozzle 101 and some other exemplary embodiments, the cross-over point is substantially at the distal end of the nozzle 101. A cross-over point may be defined as a height position (along a longitudinal axis of the nozzle) above which at least one withdrawal channel exists and at least one delivery channel exists, each of the two being different channels (e.g., separated by a solid barrier such as of glass or metal). Below the cross-over point there is not at least one dedicated withdrawal channel and at least one dedicated delivery channel.

Figure 4A:
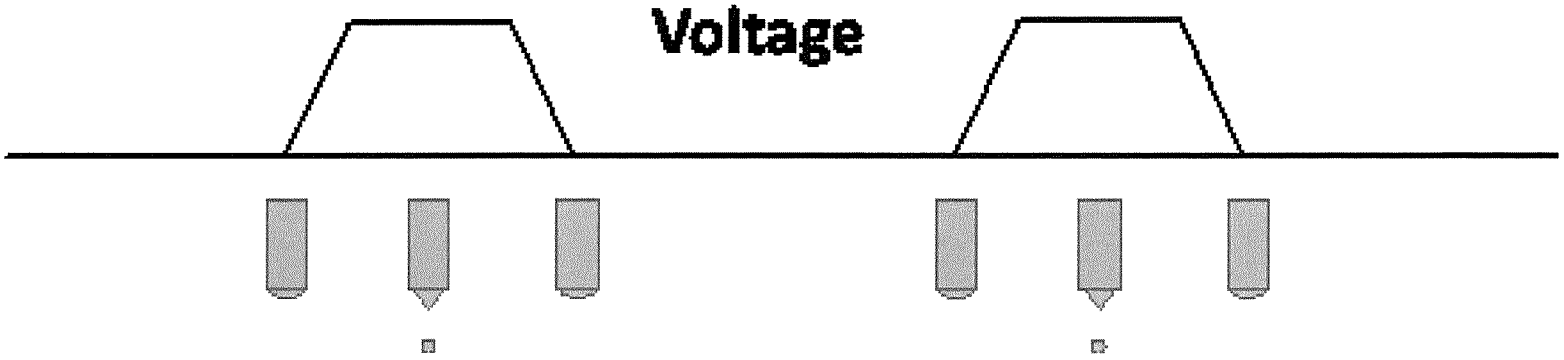
FIG. 4A is a diagram of voltage modulated EHD printing.
Figure 4B:
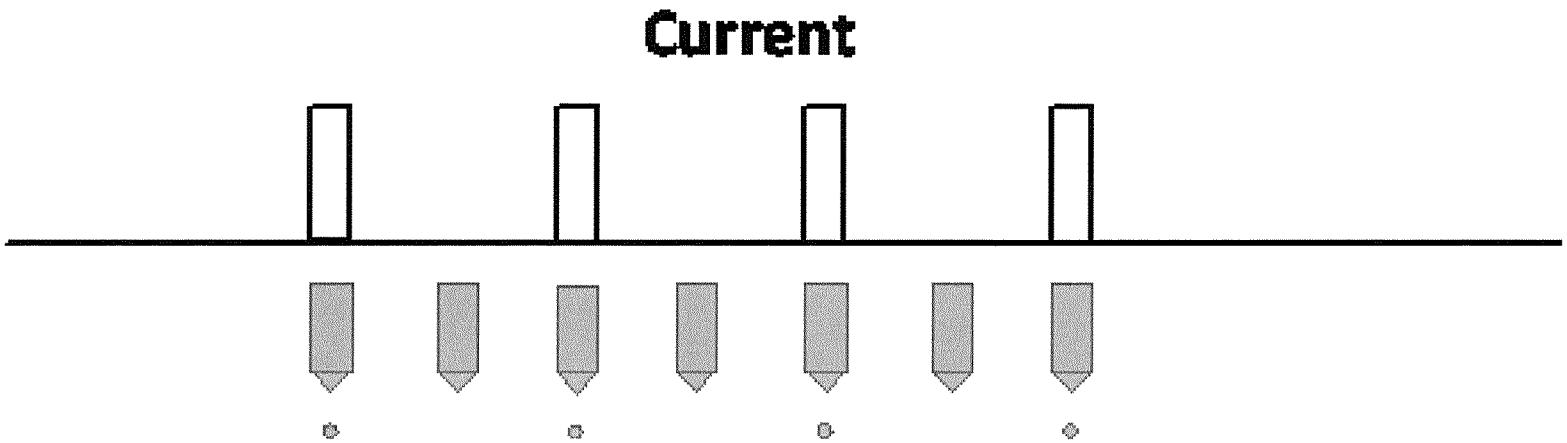
FIG. 4B is a diagram of current modulated EHD printing.
Figure 5:
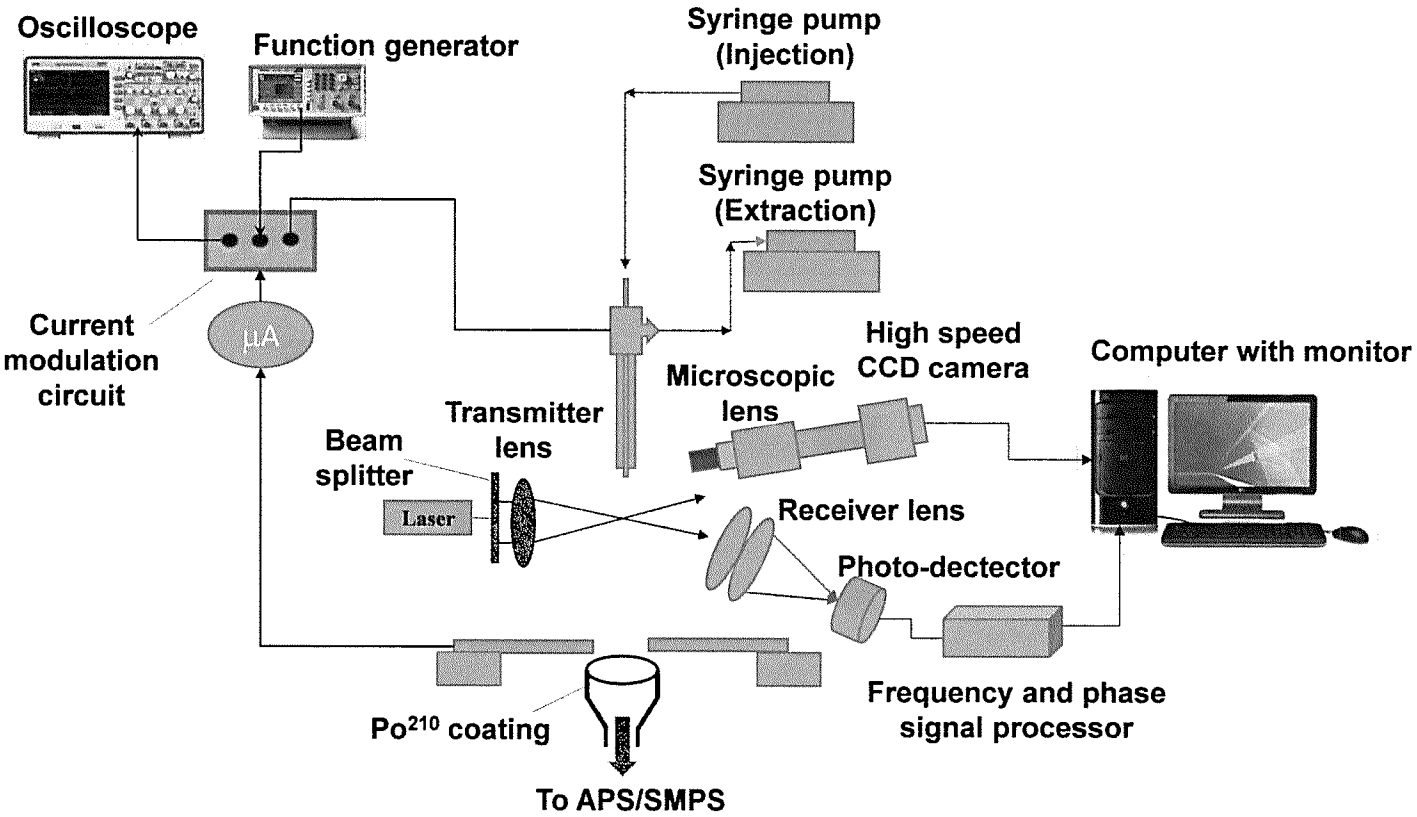
FIG. 5 is a schematic diagram of an EHD printing setup including a feedback system for monitoring, e.g., cone-jet dynamics and/or droplet size.

FIGS. 4A and 4B illustrate and compare two alternative modulation schemes for modulating EHD jet printing (modulating jetting of droplets from nozzles during a printing operation). Droplet ejection may be either voltage modulated or current modulated. The voltage modulation is provided by, for example, a jetting controller 312 (FIG. 3A). The current modulation is provided by, for example, a current modulation circuit (FIG. 5).

FIG. 4A schematically illustrates voltage modulation. In conventional voltage modulation, the liquid/ink meniscus experiences a complete cycle consisting of stages of liquid accumulation, cone and jet formation, droplet ejection, and relaxation. This cycle repeats for each desired droplet. As the applied voltage increases in a given cycle, an initial spherical meniscus at the nozzle tip changes into a conical shape due to the gradually increasing electrical charges on the liquid-air interface. This change is indicated in FIG. 4A and is also observed in the photographs of FIG. 3B. When the electrostatic stress overcomes the capillary surface tension at the apex of the meniscus, a jet emits. The jet ejection stops when the electrostatic stress is no longer stronger than the surface tension. This condition arises when the voltage is decreased by the jetting controller. The meniscus then retracts to its original spherical shape, as illustrated in FIG. 4A. The meniscus has to go through this complete cycle (e.g., of duration ~1 ms) in order to emit one droplet, which limits the jetting frequency to about 1 kHz.

FIG. 4B schematically illustrates current modulation. Current-modulation for EHD jet printing, in contrast to conventional voltage modulation, may achieve faster and more reliable control of liquid jetting and droplet formation, particularly for high frequency EHD jet printing operations. Current modulation may result in enhanced jetting stability as compared to voltage modulation. Enhanced jetting stability from current modulation may be attributed to the fact that the current in the electrical loop is the primary driver for the liquid jetting and droplet formation.

In an exemplary process of current modulation of EHD jetting, the voltage may be adjusted by comparing the real-time feedback of the EHD jetting current to "a current waveform" consisting of a pre-set current level (jetting ON) and zero current level (jetting OFF). As shown in FIG. 4B, when the EHD current is ON/OFF modulated, the ink meniscus at the nozzle opening may remain in its conical shape and, at the same time, the jetting from the cone tip can be modulated by the current control. In other words, the jetting (i.e., the ejection of droplets) in an exemplary current-modulated EHD jet printing process may be independent from the change in shape of the liquid meniscus (i.e., between rounded and conical). This control and behavior of the meniscus is fundamentally different from the voltage-modulated EHD jetting process (FIG. 4A).

The formation of a conical meniscus under the action of an electrical field and at zero flow condition may be referred to as a Taylor cone. The establishment of conical liquid meniscus at non-zero flow conditions may be referred to as Cone-jet mode. The operation of exemplary nozzles disclosed herein may be configured so as to satisfy the requirement of zero (net) flow for a Taylor cone, and an electrical field may be established under the zero EHD current condition. The jetting under the zero (net) flow condition is thus controlled by the abrupt change in the EHD current signal. Since the ink meniscus may remain in its conical shape for multiple successive droplet ejections (i.e., without resuming a rounded shape between droplets), the jetting frequency may be only be limited by the current modulation circuit which may be operated at a high frequency (e.g., greater than 0.01 MHz, greater than 0.05 MHz, greater than 0.1 MHz, greater than 0.2 MHz, greater than 0.3 MHz, greater than 0.4 MHz, greater than 0.5 MHz, greater than 0.6 MHz, greater than 0.7 MHz, greater than 0.8 MHz, greater than 0.9 MHz, as high as ~1 MHz, at least 1 MHz, etc.). Moreover, a typical measurement of EHD jetting current may be much less than 1.0 μA. Embodiments herein may employ a high-speed modulation circuit to control the ON/OFF of the jetting.

Further benefits may be realized by current modulation over voltage modulation of EHD jet printing. For example, a much larger neck-down ratio of the nozzle opening to the jet diameter (e.g., in the range of ~90-100) may be achieved by operating the EHD printing with a stable liquid cone meniscus (as is possible with current modulation) compared to cyclic formation and loss of a liquid cone meniscus (as in state-of-art voltage-modulated EHD printing). In conventional EHD printing with single capillary nozzles, the neck-down ratio is typically in the range of less than 15. The large neck-down ratio which may be realized according to current-modulated EHD printing procedures (e.g., 90-100) may enable the use of nozzles with comparatively large jetting openings. Larger jetting openings have the benefit of further minimizing the issue of nozzle clogging. Current-modulated EHD jet printing processes disclosed herein may be capable of controlling drop-on-demand printing as well as having large neck-down ratios (smaller critical feature sizes).

Current modulation may be preferred in some embodiments for its further advantage of addressing a charge accumulation issue which may be encountered in state-of-the-art voltage-modulated EHD jet printing. Modulation of AC current instead of AC voltage may reduce the undesirable charge accumulation. The issue arises because of a difference in positive and negative ion motilities in ink liquids. The amount of electrical charges carried by single droplets ejected under the action of positive and negative voltages is attributed to positive and negative ion flows during the jet breakup, respectively. Under AC-voltage modulation of EHD jet printing, the magnitude of positive and negative voltage levels is typically set the same, resulted in producing droplets carrying positive and negative charges at different amounts. The difference in the droplet charge levels can consequently lead to the charge accumulation when printed on dielectric substrates. Technically, the charge accumulation issue may be remedied by setting different levels of positive and negative voltages in an AC-voltage modulated EHD printing process. However, voltage tuning is not universal. Voltage tuning strongly depends on types of ions in printing inks, which may vary among different inks and even vary among different batches of inks which are intended to be of the same type. An AC-current modulated EHD printing process better addresses the charge accumulation issue by directly modulating the EHD current in the AC mode. Current modulation may comprise setting the same current levels in both polarities.

A variety of parameters may be set, monitored, adjusted, and/or regulated by a jetting controller (e.g., jetting controller 312, FIG. 3). FIGS. 4A and 4B highlight a major parameter: voltage modulation versus current modulation. Within these modulation regimes, there are a number of other parameters which may be used in exemplary embodiments: DC bias voltage (e.g., kV), pulse voltage (e.g., kV), and pulse width (e.g., μs), for example. As previously discussed, flow rates (e.g., μl/min) of individual channels may be independently controlled. Further parameters include printing ink properties (surface tension (e.g., mN/m), viscosity (e.g., mPa·s), and conductivity (e.g., μS/cm). One or more of these and/or other parameters may be controlled for a purpose of controlling droplet size (e.g., μm) and droplet velocity (e.g., m/s), for example.

While exemplary embodiments of the present invention have been disclosed herein, one skilled in the art will recognize that various changes and modifications may be made without departing from the scope of the invention as defined by the claims below. In practice, embodiments may involve various combinations of individual features from among the exemplary and example embodiments disclosed herein.

The following are examples for using and characterizing EHD print processes, systems, and devices.

Example 1

Example 1 involves characterizing jetting mechanisms of dual-channel EHD nozzles by voltage modulation. FIG. 5 shows an experimental setup for an EHD process and system including monitoring and feedback apparatuses. The setup comprises a typical nozzle-to-plate configuration. An open setup is employed to enable observation of the printing dynamics from different angular directions. In a production environment, more enclosures may be provided to present barriers to shield and/or substantially isolate nozzles and surfaces of the substrate at which printing is actively occurring from external environmental conditions and objects.

Electrical control is applied to the nozzles while keeping the substrate at ground. For comparison purposes, the dual-channel nozzle EHD printing is conducted under voltage modulation in this example. Two proposed dual-channel printing nozzles, as shown in FIGS. 2A and 2B, are used in this investigation: one is in the co-axial configuration and the other in the bypass flow configuration. The two configurations may have different meniscus dynamics. In the co-axial configuration, the printing nozzle is constructed by two co-axially aligned capillaries. The tip of inner capillary slightly protrudes out from the tip of the outer capillary. This arrangement may stabilize the meniscus at the inner nozzle tip. The inner diameter (ID) of inner flow channel is ~50-100 μm (with the OD of ~150 μm) and the ID of outer fluid channel is ~200 μm (with the OD of ~350 μm). Inks are fed into the printing nozzle via the inner flow channel extracted via the outer flow channel. The nozzle clogging issue is no longer an issue by continuously flowing the ink at the printing tip. In this example, the flow may also be reversed respecting injection and extraction directions in the proposed co-axial printing nozzle (compare FIGS. 1A and 2A). In the bypass flow design for a nozzle (FIG. 2B), the nozzle comprises or consists of two separate flow channels connected to the same droplet emitting opening with diameters of, e.g., ~50-100 μm. Printing inks are fed into the nozzle from one fluid channel and at the same time extracted via the other fluid channel.

Example 1.1 Meniscus Dynamics and Jetting Characteristics in Voltage-Modulated, Dual-Channel Nozzle EHD Printing This example involves dynamics of liquid/ink meniscus and jetting during the printing process and characterizes the size and mono-dispersity of droplets produced by example printing nozzles. An optical system is provided having a microscopic lens with high magnification. A high-seed camera with high resolution may be applied to monitor and record the dynamics of liquid meniscus and jetting during each printing operation. A 2-D Phase Doppler Particle Sizer (PDPA, TSI DPSS Laser units 561 nm and 532 nm at 300 mW each) may be applied for in situ characterization of droplets in the sizes larger than 300 nm. Typical organic solvents used in existed printing inks may be used as test liquids in this example.

For measuring the size distribution of droplets generated by the printing nozzles, the flat plate in FIG. 5 is replaced by a plate with an orifice (located at the substrate center) to which a specially designed particle sampling probe is attached. Radioactive sources (i.e., $Po^{210}$ of 5 mCi) are coated at the inner wall of the sampling probe entrance. $Po^{210}$ sources produce bipolar ions in the probe by ionizing air molecules. Electrical charges on produced particles are minimized once sampled through the sampling probe and the size distribution of particles can be characterized by particle sizers. For volatile solvents used in existed inks, proper solid materials are dissolved in test solvents and prepared solutions are applied. Residual particles, resulting from the complete solvent evaporation of droplets, are measured in particle sizers. The size distribution of droplets is derived from the measured size distribution of residual particles by conversion of solute mass in each droplet. If a colloidal ink is used, the droplet size may be derived from the measured size distribution of residual particles and the solid concentration in the suspension.

Two different particle sizers are applied in the proposed setup (FIG. 5) to measure the size distribution of droplets produced by the dual-channel EHD printing nozzles. One is Aerodynamic Particle Sizer (APS, TSI Model 3022) measuring particles in the sizes ranging from 0.7 to 10 μm. The other one is Scanning Mobility Particle Sizer (SMPS, TSI Model 3080) with either Nano-DMA (Differential mobility analyzer, DMA; TSI model 3085) or standard DMA (TSI model 3081) sizing columns. Based on the electrical property of particles, the SMPS measures droplets in the diameters ranging from 3 to 700 nm. The combination of two sizers enables characterization of the size distribution of particles in the range from 3 nm to 10 μm.

Example 1.2 Jetting Phase Diagram Through Parametric Study

Organic solvents, typically used as the solvents for printing ink solutions, are used in this example. Examples of the organic solvents are Tetradecane ($C_{14}H_{30}$), Tridecane ($C_{13}H_{28}$), and mixtures of water and glycerol. For the parametric study, the electrical conductivities of the above-selected solvents are varied via suitable ion additives. Trace amounts of solid material may also be dissolved in the solvents for producing residual particles. Prior to each experimental run, key physical properties of test solutions, such as surface tension, viscosity, electrical conductivity and dielectric constant, are experimentally characterized. Nano-silver and PEDOT/PSS inks are also used in this example. The flowrates of fluid injection and extraction channels are independently managed by two separate syringe pumps. The jetting may occur under various combinations of feeding and extracting flowrates (i.e., the liquid feeding flowrate may or may not be equal to the extracting flowrate). In addition, printing voltage waveforms (e.g. sinusoidal, pulsed DC/AC) are systematically varied to observe its effect on liquid/ink meniscus dynamics and jetting performance. A jetting phase diagram is developed to correlate the jetting characteristics and droplet size to the ink properties and operational parameters of EHD jet printing.

Example 2

Example 2 involves procedures for understanding the jetting characteristics of EHD jet printing with dual-channel nozzles under the current modulation. As discussed above, voltage modulation of EHD printing places a limitation on jetting frequency since the meniscus requires time to complete the cycle of expansion-jetting-retraction in order to generate one droplet. The current-modulation of EHD jet printing does not require the change of liquid meniscus shape to generate a droplet. This can significantly increase the EHD jetting frequency. The general experimental parameters for inks and printing process in Example 2 are similar to those used in Example 1. The system setup (shown in FIG. 5) combined with a current modulation circuit is utilized to carry out the jetting mechanism in this example.

Advantages of current-modulated EHD jet printing may include (1) reliable control of the dynamics of jetting at high frequency, and (2) addressment of the charge accumulation issues encountered in voltage-modulated EHD jet printing. In general, the jetting frequency of EHD jetting printing is limited by the dynamics of control circuit and formation of liquid jet. Accordingly, two sub-examples are described in this example: the first focuses is to demonstrate high-speed control of current modulation; and the other is to demonstrate the formation and dynamics of liquid jet.

Example 2.1 Current-Modulated EHD Jet Printing

An objective of this example is evaluation of the performance and limits of high-speed control of current modulation. A high-speed current modulation circuit realizes Drop-On-Demand in EHD jet printing. Because of the low electrical current typically encountered in the EHD jet printing, it is not difficult to achieve the ON/OFF switch of the EHD current in high frequency (~MHz). In addition to the ON/OFF function, the proposed current modulation circuit also includes an additional function to enable the modulation of current profile in each printing pulse. The current profile to be modulated can be triggered by external signals controlled by a computer. The current-modulated EHD jetting is investigatable under various current waveforms in each printing pulse using the proposed high-frequency current-modulation circuit.

The example setup, shown in FIG. 5, is again usable to evaluate the performance of the proposed current modulation circuit for printing applications. A high-speed camera with a microscopic lens having a long working distance and high magnification is applied to observe the liquid meniscus and jetting at the droplet emitting opening of proposed printing nozzles. Liquids with high electrical conductivities are used in this example. This is because solvents with high electrical conductivity have very short charge relaxation time in the EHD jetting process.

Example 2.2 Jetting Under Current-Modulated EHD Printing

An objective of this example is evaluation of factors affecting the response time of jetting and how this affects jetting stability. Organic solvents, listed in Example 1 above, with electrical conductivities ranging from 0.1 to 10,000 μS/cm are used in this example. By recording the liquid meniscus shape and jetting in each printing pulse via a high-speed camera, the response time of liquid meniscus and jetting can be measured. The dynamics of liquid meniscus and jetting under different current profiles in each printing demand and printing sequences may also be observed.

Example 3

Example 3 involves feature size and uniformity of micro-/nano-patterns on substrates and its relationship with operational parameters and ink properties in current-modulated EHD jet printing. Example 3 establishes the processing-structure-performance relationships by permitting parametrically studying the effects of the printing process parameters and ink properties on the topography and structures of printed features.

Example 4.1. Printing of Dot, Line, and or Film Patterns

Depending on specific applications, the critical measures of printed micro/nano-patterns may be varied. For example, for source and drain electrodes in an inkjet-printed transistor, smooth edge with well-controlled and narrow separation (channel length) is of importance while the width is less critical. For printed electronics, the requirement of either conductivity (for electrodes, interconnect etc.) or resistivity (for insulators) makes it desirable to have uniform thickness without breaking lines and ruptured films. Pinholes in the lines or films lead to an electrical defect, which can cause unwanted consequences in the device performance, especially in electrically important layers such as dielectrics, semiconductor films and electrodes.

Figure 6:
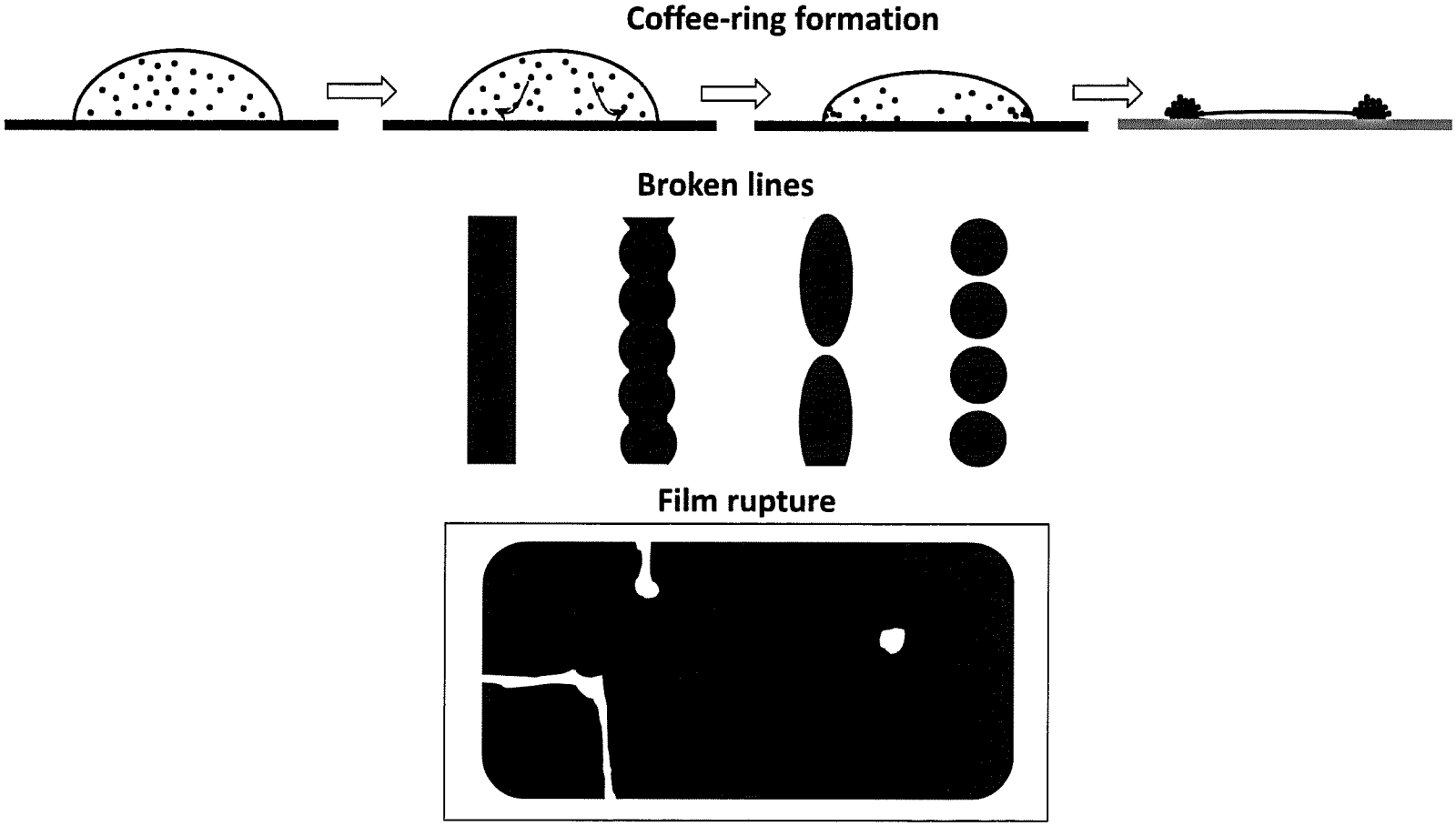
FIG. 6 illustrates issues which can arise during general inkjet printing, including coffee-ring effect, issues of line morphology, and film rupture.

FIG. 6 shows typical printing defects in inkjet-printed dots, lines, and films, i.e., coffee-ring formation, broken lines, and ruptured films, respectively. Compared to the relatively mature inkjet printing process and extensively studied inkjet droplet evaporation and interactions of droplet/substrate and droplet/droplet coalescence, a majority of EHD jet printing research has focused on the demonstration of new materials printability and new device fabrications, while the printed micro/nano structure and droplet/substrate interactions have not been investigated in a systematic way. This example identifies the unique characteristics of dots, lines, and solids prepared by EHD jet printing. Because of its nature of generating charged droplets in small sizes (and fast evaporation), the formation of dots, lines and solid films can be quite different from those achieved in conventional inkjet printing. A phase diagram of pattern formation vs. the parameters of printing frequency, electric field intensity, droplet size and spacing, etc. may be developed to provide guidance in generating submicron/nano-sized lines and films with uniform thickness and smooth edges.

Example 4.2. Metrology and Electrical Property Characterization

Scanning electron microscopy (SEM) and atomic force microscopy (AFM) may be utilized to image the printed patterns. SEM provides overall droplet placement accuracy, line raggedness, and dimensional integrity of produced micro/nano-patterns. AFM quantitatively characterizes thickness variation within printed patterns, the uniformity of edge, and bulk of lines/films. Electrical resistance of a deposited film may be measured using AFM Scanning Spreading Resistance Mode. The spatial resolution of a commercially available diamond coated silicon tip is about 10-20 nm.

What is claimed is:

1. A jetting apparatus for printing, comprising at least one droplet emitting opening for ejecting a printing fluid; and at least two channels configured to permit contemporaneous delivery of the printing fluid to the droplet emitting opening and withdrawal of printing fluid from the droplet emitting opening, wherein each of the at least two channels has a longitudinal axis, and wherein the longitudinal axes of the at least two channels are oriented at a 0-90 degree angle relative to one another; and a flow controller configured to control printing fluid flow in the at least two channels and to continuously circulate or recirculate the printing fluid past the at least one droplet emitting opening, and wherein the printing fluid ejected from the at least one droplet emitting opening has a conical meniscus.

2. The jetting apparatus of claim 1, wherein the flow controller circulates or recirculates the printing fluid past the droplet emitting opening during ejection of droplets and during time between ejection of droplets.

3. The jetting apparatus of claim 1, wherein the at least two channels are configured such that the circulation or recirculation past the droplet emitting opening prevents any printing fluid stagnation at the droplet emitting opening.

4. The jetting apparatus of claim 1, wherein the flow controller is configured such that rates of printing fluid flow delivery and printing fluid flow withdrawal are independently adjustable to be the same or different.

5. The jetting apparatus of claim 1, wherein the flow controller comprises one or more pumps or pressure regulators.

6. The jetting apparatus of claim 5, wherein the one or more pumps or pressure regulators consists of a single pump or pressure regulator configured to recirculate printing fluid.

7. The jetting apparatus of claim 5, wherein the one or more pumps or pressure regulators comprises at least two pumps or pressure regulators, one configured for printing fluid delivery and the other configured for printing fluid withdrawal.

8. The jetting apparatus of claim 1, wherein the least two channels are tubules or capillaries.

9. The jetting apparatus of claim 1, wherein the at least two channels comprise three or more channels.

10. The jetting apparatus of claim 1, wherein the jetting apparatus is a nozzle.

11. The jetting apparatus of claim 10, wherein the at least two channels of the nozzle are in a co-axial or bypass flow configuration.

12. The jetting apparatus of claim 1, wherein the jetting apparatus is a printhead with a plurality of nozzles.

13. The jetting apparatus of claim 1, wherein the at least two channels are configured to permit contemporaneous delivery of printing fluids that are conductive.

14. The jetting apparatus of claim 1, wherein the at least two channels are configured to permit contemporaneous delivery of printing fluids that contain a metal.

15. The jetting apparatus of claim 1, wherein the printing is electrohydrodynamic jet printing and further comprising a device for applying a voltage or current to the printing fluid at the at least one droplet emitting opening.

16. A jetting apparatus for drop-on-demand printing, comprising at least one droplet emitting opening for ejecting a printing fluid; and at least two channels configured to permit contemporaneous delivery of the printing fluid to the droplet emitting opening and withdrawal of printing fluid from the droplet emitting opening, wherein the at least two channels are coaxial with one another.

17. A method of preventing clogging of a drop-on-demand jetting apparatus, comprising delivering printing fluid to a droplet emitting opening of a jetting apparatus using at least one channel; and withdrawing printing fluid from the droplet emitting opening using at least one additional channel, wherein said withdrawing step is performed contemporaneously with said delivering step, and wherein the at least one channel and the at least one additional channel each have a longitudinal axis, and wherein the longitudinal axes of the at least one channel and the at least one additional channel are oriented at a 0-90 degree angle relative to one another; and controlling printing fluid flow with a flow controller in the at least one channel and the at least one additional channel to continuously circulate or recirculate the printing fluid past the at least one droplet emitting opening, and wherein the printing fluid ejected from the at least one droplet emitting opening has a conical meniscus.

18. The method of claim 17, wherein controlling performed such that continuously circulating or recirculating printing fluid past the droplet emitting opening occurs during ejection of droplets and during time between ejection of droplets.

19. The method of claim 18, further comprising independently adjusting rates of printing fluid flow delivery and printing fluid flow withdrawal to be the same or different.

20. The method of claim 17, wherein the step of controlling is performed such that continuously circulating or recirculating printing fluid prevents any printing fluid stagnation at the droplet emitting opening.

21. The method of claim 17, wherein the delivering step comprises delivery of a printing fluid that is conductive, and the withdrawing step comprises withdrawal of the printing fluid that is conductive.

22. The method of claim 17, wherein the delivering step comprises delivery of a printing fluid that contains a metal, and the withdrawing comprises withdrawal of the printing fluid that contains a metal.

23. The method of claim 17, wherein the jetting apparatus is an electrohydrodynamic jetting apparatus, further comprising the step applying a voltage or current to the printing fluid at the at least one droplet emitting opening.

* * * * *